United States Patent [19]

Eichelberger, Sr.

[11] Patent Number: 4,785,758

[45] Date of Patent: Nov. 22, 1988

[54] RELEASABLE MARINE ANCHOR

[76] Inventor: Philip T. Eichelberger, Sr., 1415 Kathy, Arcola, Tex. 77583

[21] Appl. No.: 861,278

[22] Filed: May 9, 1986

[51] Int. Cl.[4] ..... B63B 21/46

[52] U.S. Cl. ..... 114/299; 114/301

[58] Field of Search ..... 114/294–301; 405/224; 102/411

[56] References Cited

U.S. PATENT DOCUMENTS

| | | | |
|---|---|---|---|
| 242,957 | 6/1881 | Moule | 114/301 |
| 305,186 | 9/1884 | Herman | 114/301 |
| 372,938 | 11/1887 | Smith | 114/301 |
| 895,648 | 8/1908 | Laubeuf | 114/301 |
| 1,636,760 | 7/1927 | Swift | 114/297 |
| 2,161,906 | 6/1939 | Filby | 114/301 |
| 2,306,454 | 12/1942 | Marshaus | 114/300 |
| 3,158,127 | 11/1964 | Gallaugher | 114/300 |
| 4,068,609 | 1/1978 | Hoetker | 114/301 |
| 4,403,564 | 9/1983 | Garvin | 114/303 |

*Primary Examiner*—Joseph F. Peters, Jr.
*Assistant Examiner*—Clifford T. Bartz
*Attorney, Agent, or Firm*—Darryl M. Springs

[57] ABSTRACT

Apparatus for releasably mooring a marine vessel. An elongate anchor stem terminates at opposing ends with a swiveling connector assembly adapted for attachment to a boat anchor line and a fluke assembly. The fluke assembly includes a base plate with a plurality of curved anchor arms extending radially outwards therefrom, each terminating in a fluke. Each fluke defines a pair of opposing projections adapted to matingly engage a link of a connecting chain attached to one end of the stem and comprising a portion of the connector assembly. Upon such mating engagement a bridle is formed, whereupon exertion of upward force on the anchor line causes the anchor to more readily disengage from the floor of the water body and/or any foreign objects.

3 Claims, 1 Drawing Sheet

RELEASABLE MARINE ANCHOR

BACKGROUND OF THE INVENTION

This invention relates to anchoring and mooring devices adapted for marine usage, and more particularly relates to an anchor apparatus having improved releasing properties for use with boats In the design of boat anchors two desirable features are sought which frequently are in conflict resulting in the difficulty in achieving effective designs, namely provision of an anchor which will reliably moore the vessel while at the same time being readily releasable when desired. Various mechanisms have been provided for attempting to accomplish both objectives, however they suffer from numerous defficiencies such as undue complexity and difficulty of manufacture, unreliability of the release mechanism and the like.

Representative. such mechanisms may be seen depicted in U.S. Pat. Nos. 2,424,040 to Long, 2,796,844 to March, 2,816,522 to Root, 3,263,642 to Wilson, 3,269,348 to Churchward, 4,337,717 to Gregory 4,403,564 to Garvin, 1,584,132 to Peterson, and 1,636,760 to Swift. Even a brief review of these references will reveal the numerous defficiencies, which, in particular may include provision of a number of projections, sharp edges and the like which undesirably may engage and become fouled in material such as undersea cables; complicated multi-part constructions which are inherently more unreliable and costly to manufacture including springs, sliding members, etc.; and difficulty in a "hooking" operation of the anchor from the surface as in the case of U.S. Pat. No. 1,636,760 to Swift for example.

Accordingly, a novel anchor design was long sought after which is provided in the subject invention which was safe and of simple construction, requiring few parts, inexpensive to manufacture, reliably and simply engageable with the floor of water bodies such as sea beds, river bottoms, and the like to moore vessels, yet at the same time being easily and quickly releasable for retrieval of the anchor at the vessel when desired, thus overcoming the hereinbefore described problems with previously existing designs.

SUMMARY OF THE INVENTION

An elongate anchor stem in the form of a tubular member is provided terminating at opposing ends with a swiveling connector assembly adapted for attachment to a boat anchor line and a fluke assembly, respectively. The connector assembly includes an eyebolt rotatable about the longitudinal axis of the stem and a length of connecting chain attached thereto at one end, the remaining end of which is attachable to a boat anchor line or the like.

The fluke assembly includes a pair of circular base plates disposed at the other end of the stem and lying in a plane generally perpendicular to the stem axis. Radiating radially outwards from the base plates in a sandwich-like fashion is a plurality of curved anchor arms disposed preferably from the base plates at equally spaced locations about the circumference of the plates. In a preferred embodiment five such arms are provided extending from locations on the plates and regularly spaced so as to define a pentagon. Each arm is curved so that after extending a short distance in a direction generally perpendicular to the stem axis it bends back toward the stem axis and terminates in a respective fluke mounted on the inside surface closest to the stem of its respective arm.

Each fluke is fashioned in a generally rectangular shape with two parallel sides, and an outermost end having a convex portion and a flat portion on either side thereof. The innermost end of each fluke opposing the aforesaid outermost end includes a concave portion and a flat portion on either side thereof whereby a pair of chain link-engaging projections are defined.

Each projection has a cross section with a maximum width small enough to permit extension of the projection into the oval area defined by a link of the connecting chain disposed from one end of the anchor stem.

Each projection further is spaced to either side of the axis of its respective arm and points in a direction generally away from the anchor stem end to which the chain is attached. The projections bend in a direction generally away from the stem axis and below the radially innermost surface of its respective fluke. Thus a smooth surface is effected on the radially innermost surfaces of the flukes and corresponding arms.

In operation, when the anchor of the present invention is lowered to the floor of a body of water, the longitudinal axis of the stem when the anchor is at rest will typically extend at an angle from the bed with a portion of the flukes engaging the floor and a portion of the connector assembly resting on the floor. In this manner, the engagement of the flukes into the bed will prevent movement of the anchor in the general direction toward which the flukes point, thereby mooring the vessel interconnected thereto by means of a boat anchor line.

However, when it is desired to dislodge and retrieve the anchor, the operator on the vessel will cause the anchor line attached to the connector assembly at one end of the stem to move in a direction generally toward the opposing end of the stem and toward the flukes. This will cause a portion of the connector assembly which comprises a length of chain attached at one end to the anchor stem end and at the other to the anchor line to move between the vertically uppermost anchor arm and fluke and an adjacent anchor arm and fluke on either side thereof.

Upon thereafter moving the anchor line back in a direction generally opposed to that of the first motion which brought the chain between adjacent anchor arms and flukes, a link in the chain is thereby made to engage one of the projections on the uppermost fluke on either side of the arm from which it extends. A triangularly-shaped bridle is thereby formed by the chain portion extending from the stem end to the projection, the stem, and the arm carrying the fluke having the projections.

Upon thereafter exerting a force on the anchor line from the vessel and generally in an upwards direction, the connecting chain portion between the anchor line and where the chain engages the fluke will extend vertically upwards and away from the rest of the anchor, thereby suspending the anchor from the projection with the stem axis pointing generally downwards and the inner fluke surfaces extending in a generally vertical direction. Further upward force will cause the flukes engaging the floorbed and/or a foreign object to thereby disengage, freeing the anchor for retrieval at the surface by means of the anchor line.

The anchor is preferably weighted whereby mass on one side of a vertical plane extending through the supporting projection relative to mass on the other side of the plane is distributed so that when the anchor is supported by the chain from the projection in bridle-like fashion, the stem axis will point generally downward with the planes defined by the inner fluke surfaces extending generally upwards.

When the anchor is unsuspended from a projection and oriented with the stem axis extending upwards relative to the direction it extends when suspended from the projection, an area is defined between the fluke, the arm, a line extending from the fluke to the stemm which also defines an opening, and a portion of the stem between where the line intersects the stem and the stem end to which the arms are connected.

Foreign objects such as rock projection or undersea cables may snag in this area. However, upon suspending and lifting the anchor from the fluke projection, due to the aforesaid weighting, the stem axis will rotate to a generally downward angle along with the flukes. Moreover, the area will rotate and the opening will face a more generally downward direction backing out around from the foreign object which moves out of the area. Upon subsequent vertical lifting of the bridled anchor from the projection, the anchor is thereby freed from the foreign material.

The structure of the present invention as well as the features, advantages, benefits, and objects thereof over other designs known in the art may be better understood with reference to the following detailed description in conjunction with the drawings, wherein:

DETAILED DESCRIPTION OF THE PREFERRED EMBODIMENT

Figure 1:
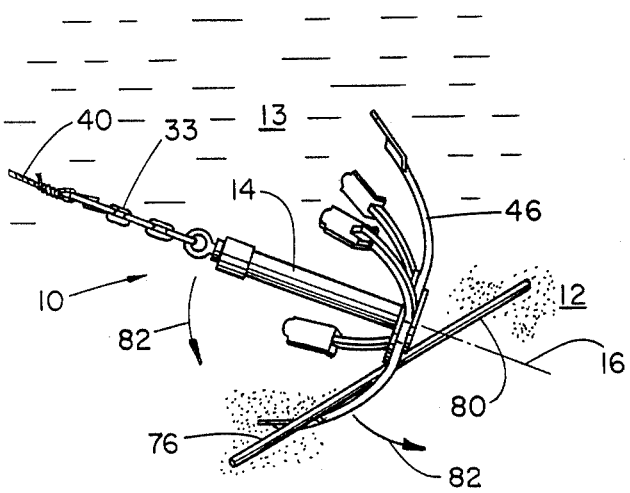
FIG. 1 is an pictorial illustration of the anchor of the present invention, with the connecting chain thereof depicted in two positions.

Referring now to FIG. 1 of the accompanying drawings, there will be seen depicted therein an anchor 10 of the present invention disposed in an operating position on the bed or floor 12 of a body of water 13. The main member of anchor 10 is an elongate anchor stem 14 fashioned of an appropriate tubular member and defining a longitudinal axis 16. The proximal end of the stem 14 (see FIG. 3) preferably is threaded on the outer surface thereof with threads 18 for threadedly and retainedly holding a connector assembly 19. The connector assembly is preferably comprised of an end cap 20 internally threaded to mate with the threads 18 and including an aperture 22 in the end thereof; a swiveling eyebolt 24 having a threaded shaft 26; a pair of nuts 28 and 30; and a length of connecting chain 33. The threaded end portion of shaft 26 extends into the aperture 22 in the end cap 20 and is retained by means of the nuts 28 and 30, with the shoulder 29 of the shaft 26 abuttingly engaging the outer surface of the cap 20.

The connecting chain will preferably include a master link 34 connected to the eye of the eyebolt 24, and a length of chain 36, terminating in another master link 38. This master link 38 will in turn be connected to a boat anchor line 40 leading to the water surface at an appropriate location such as a surface vessel or the like when the anchor is in use.

Figure 3:
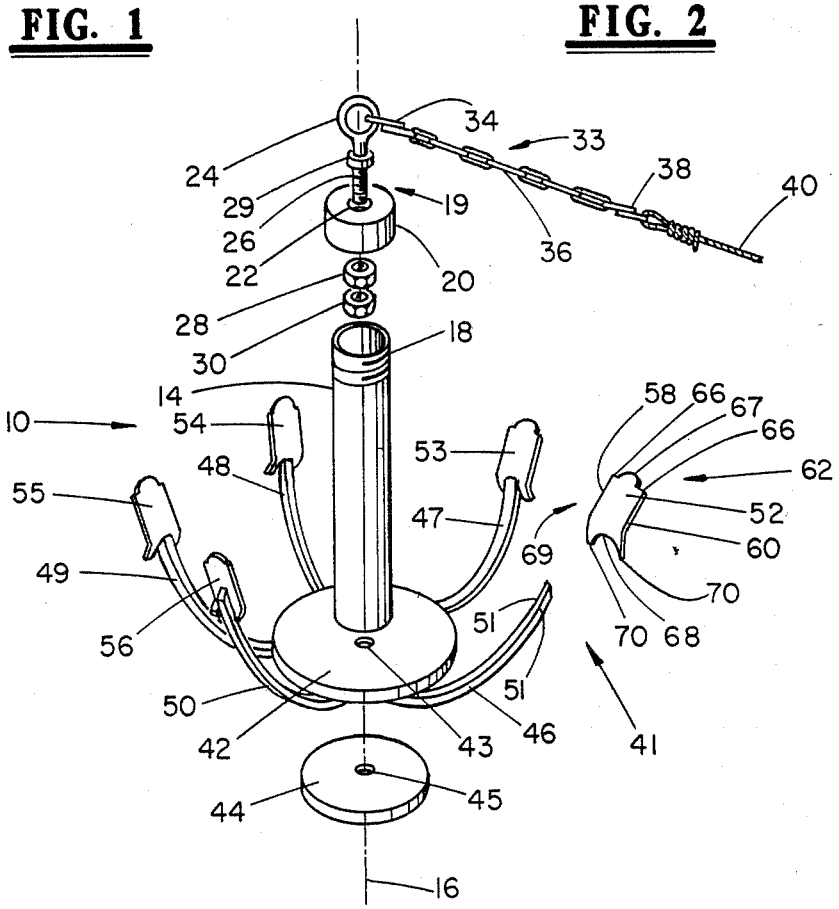
FIG. 3 is an exploded pictorial illustration of the anchor of FIG. 1.

Referring to FIG. 3, at the distal end of the anchor stem 14 a circularly shaped first base plate 42 having a central aperture 43 is preferably provided lying in a plane generally transverse to that of axis 16 and attached to the stem 14 by any convenient means such as a circumferential weld joint at locations where the stem 14 and base plate 42 meet. As can be seen from FIG. 3, a smaller circular second plate 44 parallel to that of the baseplate having an aperture 45 extending therethrough is provided for purposes to be hereinafter described. The plates 42 and 44, a plurality of curved anchor arms 46–50 sandwiched therebetween and held in place by weld joints to plates 42 and 44, and a like plurality of flukes 52–56 attached to the end of each respective arm 46–50 to be described comprise what will be hereinafter referred to as a fluke assembly 41.

Each anchor arm of the plurality 46–50 will curve in a direction preferably away from the distal end and toward the proximal end of the stem 14. Moreover, as can be seen from FIG. 3, the locations on the outer circumferential periphery of the plate 42 from which these arms 46–50 extend will preferably be evenly spaced about the periphery. Furthermore, it will be noted that five arms 46–50 have been shown. However it will be appreciated that the invention is not intended to be so limited, but admits to a construction of any desired number of such arms such as three. A particular benefit to an odd number of such arms may be appreciated, though, inasmuch as with such an odd number, no matter which two arms contact the bottom 12 of the body of water 13 as shown in FIG. 1, a remaining arm will be disposed vertically upwards for purposes which will hereinafter be made more clear of engaging a portion of the connecting chain 33.

Referring now to FIG. 3 in more detail in conjunction with FIG. 1, the particular preferred construction of the plurality of flukes 52–56 will now be described. A fluke for releasably engaging the bottom 12 is provided for each arm 46–50 and disposed on the radially outer end thereof by any convenient means well known in the art such as a weld or the like. With respect to each such fluke, it will preferably be of a generally rectangular shape, having a pair of substantially parallel sides 58 and 60, and a pair of opposing ends. The uppermost first end will be seen to include a convex generally semi-circularly shaped portion 67 having on either side thereof a flat end portion 66. This first end 62 will be radially outermost of the stem 14. The innermost second end will further be seen to include a concave generally semi-circularly shaped portion 68 having on either side thereof a projection 70. Each projection will extend on either side of and accordingly be spaced off its corresponding anchor arm from which it depends so as to receive a chain link to be hereinafter described.

Referring now to operation of the invention in greater detail, with reference to FIG. 1 the connecting chain 33 will be seen depicted therein in a first position wherein it is disengaged from the flukes 52–56. This is the typical position when the anchor 10 is serving its intended purpose of mooring a marine vessel or the like. However, a closer view of FIG. 2 reveals an alternate positioning of the chain 33 when it is desired to dislodge the chain 33 from the bottom 12. More particularly, in this position it will be noted that the chain 33 has been maneuvered from the surface whereby a link 72 thereof has been made to engage the uppermost anchor arm 46 (see FIG. 1), or more precisely, one of the projections 70 extending from the fluke 52 carried by the arm.

In order for such engagement to be possible, it will be readily appreciated that the cross section of the projections 70 must be such that the widest dimension thereof is sufficiently small relative to the area circumscribed by the links of the chain length 35 so as to permit such extension of the projection into the chain link.

Figure 2:
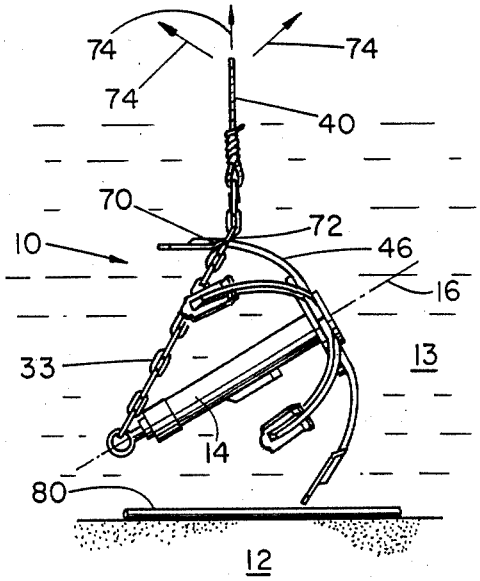
FIG. 2 is another pictorial illustration of the anchor when being released.

With the chain 33 in the position depicted in FIG. 2, when a force is exerted from the surface at the vessel for example in the general directions shown by the arrows 74, it will be appreciated that a corresponding force will thus, in turn, be exerted upon the flukes 52–56. However a particular feature of the present invention may be noted by a comparison of FIGS. 1 and 2. It is a feature of the present invention to provide for a more readily releasable and snag-proof design.

With a foreign object such as the underwater cable 80 or a rock or other foreign material disposed in the general location shown by cable 80, the object will prevent retrieval of the anchor by pulling with force on the anchor line in the general direction of the line depicted in FIG. 1. However, upon effecting the formation of the previously described bridle, as shown in FIG. 2 and exerting a lifting force on the anchor line, the anchor of the present invention is made to rotate about the foreign object from the position depicted in FIG. 1 to that of FIG. 2. Further upward force on the anchor line will retrieve the anchor as desired.

Such rotation is caused by the preselected weight distribution of the subject anchor design. More particularly, with reference to FIG. 2, a vertical plane may be visualized passing through the fluke projection to which the chain 33 is attached when in the bridled position. Mass of the anchor on one side of this plane will preferably be distributed spatially relative to mass on the other side of the plane so that upon suspending the anchor as shown in FIG. 2, the axis 16 of the stem will move generally downward and more importantly, the radially inner surface of the lower flukes which might otherwise snag the object 80 move to a more upright position to facilitate retrieval of the anchor. Thus it can be seen that the anchor may be made to rotate about the object 80 and "back out" from around the object, rotating in a manner shown by the arrows 82 (see FIG. 1).

Other features of the present design may also be noted. From the accompanying figures, it will be noted that the projection 70 preferably slope in a radially outward direction away from the plane defined by the radially inner portion of the reset of the fluke. Moreover these inner fluke surfaces are preferably flush with the radially inner surface of the anchor arms. The provision of this substantial flushness and the outward sloping of the projections permits foreing objects such as the cable 80 to slide smoothly on the radially inner surface of the flukes and arms to facilitate freeing the anchor therefrom, while, at the same time, providing locations on the flukes which may readily be engaged by the chain for retrieval of anchor. Moreover, it will be noted that prior to the bending of the projections 70 and attachment of the flukes to the arms, the concave portion and sides of one fluke will conform in shape to the covex portion and sides of another fluke. In this manner a plurality of flukes may be cut out of one strip of metal stock whereby the head of one fluke is the tail of the next fluke.

The apertures 43 and 45 in the baseplates 42 and 44, respectively, serve two purposes. First they facilitate drainage of the anchor. However they also facilitate construction thereof. More particularly, in a preferred method of construction, straight stock is for the arms is inserted between the plates and a bolt inserted through the apertures which are in registry and fastened in place with a nut. The plates thus act as a jig to hold the arm stock in place whilst it is welded to the plates and bent to the desired angles if desired or otherwise operated upon, such as by installation of the flukes and machining thereof. Moreover, the plate 42 further serves as a drag surface engaging the bed 12 to prevent slippage of the anchor.

Whereas the invention admits of several variations in design, details of construction of a particular embodiment which has been found to be extremely effective with smaller craft may be seen with reference to the accompanying table:

TABLE OF SPECIFICATION (dimensions in inches)

| | |
|---|---|
| Master links 34,38 | 2¼ long, 1¼ wide, 5/16 thick |
| Chain 33 | Links 1½ long, ¾ wide, 3/16 thick |
| Eyebolt 24 | 4 long, 5/16 thick, threaded 2 inches, i.d. of eye 1 inch |
| End cap 20 | 1¼ pipecap, threaded, with ⅜ inch aperture 22 |
| Stem 14 | 8 long, 1¼ o.d., 1 inch end thread |
| Plate 42 | 5 in. diameter, ⅛ thick |
| Plate 44 | 3 in. diameter, ⅛ thick |
| Arms 46–50 | ½ in. square stock, 8 in. long; 1½ in straight at either end; 5 in. remaining stock in middle at 81 degree angle bend relative to axis 16 |
| Flukes 52–56 | ⅛ thick plate steel; 3½ long × 2 wide |

It is apparent that the present invention is one well adapted to obtain all of the advantages and features hereinabove set forth, together with other advantages which will become obvious and apparent from a description of the apparatus itself. Moreover, the foregoing disclosure and description of the invention is only illustrative and explanatory thereof and admits of various changes in size, shape, and material composition of components and details of illustrated construction without departing from the scope and spirit thereof.

What is claimed is:

1. A marine anchor for engaging the bed of a body of water and mooring a vessel to an interconnecting line and capable of being dislodged from engagement with a submerged object by use of the line, comprising an elongated anchor stem having a proximal and distal end and defining a longitudinal axis, an odd numbered plurality of curved anchor arms equally spaced about said anchor stem and having one end attached to said distal end thereof and extending radially outwardly and upwardly therefrom, said arms terminating in free ends angularly disposed with respect to said longitudinal axis intermediate said proximal and distal ends of said anchor stem, an odd numbered plurality of fluke elements each having a generally flat body portion with an outermost end and an innermost end, said outermost end being adapted for engaging the bed of the body of water and the innermost end having depending therefrom a pair of spaced projections disposed in a plane angularly intersecting the plane of said generally flat body portion, each of said projections having a predetermined maximum width, one each of said fluke elements being mounted on one of said anchor arm free ends with said fluke outermost end projecting beyond said free end of said anchor arm and orienting said generally flat body portion angularly facing said anchor stem, said innermost end positioning one of said pair of spaced projections on either side of said anchor arm and extending in a direction away from said proximal end of said anchor stem, and a chain connected at one end to said proximal end of said anchor stem and having a predetermined length that exceeds the distance from said proximal end of said anchor stem to each of said anchor flukes, each of the links of said chain having openings therein exceeding said predetermined width of said fluke projections, the free end of said chain interconnected to the anchor link attached to the vessel, wherein when the anchor is disposed in engagement with the bed of the body of water, the bed will be engaged by a lower pair of said arms and flukes for positioning one of said remaining arms and attached fluke in a generally vertical orientation, above the bed, and wherein when at least one of said pair of lower arms and flukes engage a submerged object, the line may be manipulated from the vessel to move said chain into contact with said vertically oriented anchor arm and attached fluke for causing one of said chain links to engage one of said fluke projections, whereby the anchor line may then be raised to lift said engaged fluke and anchor arm for shifting the mass distribution of the anchor and causing said proximal end of said anchor stem to move downwardly and move said engaged anchor arms and flukes out of engagement with the submerged object to free the anchor for retrieval.

2. The marine anchor as described in claim 1, wherein said odd numbered plurality of anchor arms is five.

3. The marine anchor as described in claim 1, wherein the relatively flat inner surface of said fluke body portion facing said anchor stem provides a surface adjacent the inner surfaces of said curved anchor arms to provide a generally smooth surface from said anchor stem to the outermost end of said fluke.

* * * * *